US007229955B2

(12) United States Patent
Dasque et al.

(10) Patent No.: US 7,229,955 B2
(45) **Date of Patent: *Jun. 12, 2007**

(54) DETERGENT PRODUCT

(75) Inventors: Bruno Matthieu Dasque, Newcastle upon Tyne (GB); Nicola Ethel Davidson, Newcastle upon Tyne (GB); Francesco de Buzzaccarini, Breendonk (BE); James Charles Theophile Roger Burckett-St. Laurent, Cincinnati, OH (US); Valerio Del Duca, Rome (IT); Frank William DeNome, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/212,221

(22) Filed: Aug. 26, 2005

(65) Prior Publication Data

US 2005/0282725 A1 Dec. 22, 2005

Related U.S. Application Data

(63) Continuation of application No. 11/192,563, filed on Jul. 29, 2005, which is a continuation of application No. 10/204,258, filed on May 14, 2003, now Pat. No. 6,995,125.

(30) Foreign Application Priority Data

| | | |
|---|---|---|
| Feb. 17, 2000 | (EP) | 00870023 |
| Jun. 9, 2000 | (EP) | 00870124 |
| Jul. 19, 2000 | (WO) | PCT/US00/19619 |
| Jul. 25, 2000 | (WO) | PCT/US00/20255 |
| Nov. 29, 2000 | (WO) | PCT/US00/32533 |

(51) Int. Cl.
*C11D 17/04* (2006.01)

(52) U.S. Cl. ..... 510/296; 510/439; 510/406

(58) Field of Classification Search ..... 510/296, 510/439, 406

See application file for complete search history.

(56) References Cited

U.S. PATENT DOCUMENTS

| | | | | |
|---|---|---|---|---|
| 3,131,991 | A | 5/1964 | Lindner et al. | |
| 4,743,394 | A | 5/1988 | Kaufmann et al. | |
| 4,846,992 | A * | 7/1989 | Fonsny | 510/296 |
| 4,886,615 | A | 12/1989 | Dehan | |
| 4,929,380 | A | 5/1990 | Schulz et al. | |
| 4,973,410 | A | 11/1990 | Pinschmidt, Jr. et al. | |
| 4,973,416 | A | 11/1990 | Kennedy | |
| 5,008,031 | A | 4/1991 | Schulz et al. | |
| 6,037,319 | A | 3/2000 | Dickler et al. | |
| 6,670,314 | B2 * | 12/2003 | Smith et al. | 510/220 |
| 6,727,215 | B2 | 4/2004 | Roberts et al. | |
| 6,812,199 | B2 * | 11/2004 | Dasque et al. | 510/439 |
| 6,878,679 | B2 * | 4/2005 | Sommerville-Roberts et al. | 510/296 |
| 6,995,125 | B2 * | 2/2006 | Dasque et al. | 510/296 |
| 2004/0033921 | A1 | 2/2004 | Dasque et al. | |

FOREIGN PATENT DOCUMENTS

| | | |
|---|---|---|
| DE | 40 09 532 A1 | 9/1991 |
| EP | 0 158 464 B1 | 10/1985 |
| EP | 0 236 136 B1 | 9/1987 |
| EP | 0 253 566 A2 | 1/1988 |
| EP | 0 414 462 A2 | 2/1991 |
| EP | 0 414 463 B1 | 2/1991 |

OTHER PUBLICATIONS

U.S. Appl. No. 11/192,563, filed Jul. 29, 2005, Dasque et al.

* cited by examiner

*Primary Examiner*—Lorna M. Douyon
(74) *Attorney, Agent, or Firm*—Jeffrey V. Bamber; Armina E. Matthews; Kim William Zerby

(57) ABSTRACT

A composition in a water-soluble pouch, the pouch comprises at least two compartments, and each compartment contains a different component of the composition, wherein a first compartment contains a first component and the first component comprises a liquid matrix and a source of peracid.

22 Claims, No Drawings

DETERGENT PRODUCT

This application is a continuation of pending U.S. application Ser. No. 11/192,563 filed on Jul. 29, 2005, which is a continuation of U.S. application Ser. No. 10/204,258 filed on May 14, 2003, now U.S. Pat. No. 6,995,125, which in turn claims priority under 35 USC 119 to PCT/US00/32533 filed Nov. 29, 2000; PCT/US00/20255 filed Jul. 25, 2000; PCT/US00/19619 filed on Jul. 19, 2000; EP 00870124.5 filed Jun. 9, 2000 and EP 00870023.9 filed on Feb. 17, 2000.

TECHNICAL FIELD

The present invention relates to the field of detergent compositions, especially detergent compositions for use in the process of washing fabrics.

BACKGROUND

Many consumers do not want to come into contact with detergent ingredients commonly used and found in detergent products, during the washing process. The detergent industry has been trying to prevent or minimize the contact between detergent ingredients and the consumer. For example, the detergent industry developed detergent tablets which minimized the generation of detergent ingredients in the form of dust when handled by a consumer during the washing process. However, these detergent tablets still produce dust when handled by consumers during the washing process. Thus, there is still a need to provide a detergent product which can be used by consumers wherein the contact between the detergent ingredients therein and the consumer is prevented or further minimized.

Attempts have been made to solve this problem by enclosing the detergent ingredients with a film, to form a detergent pouch. These pouched detergents have been further developed by the laundry industry to improve their water-solubility profile and cleaning performance.

In addition, consumers like the benefits of having unit dose detergent products, for example detergent tablets and detergent pouches. Many consumers find unit dose detergent products easier and quicker to use during the washing process. For example, by using unit dose detergent products, the amount of detergent to be used during the washing process is already pre-selected for the consumer, negating the need for the consumer to determine, and weight out, the desired amount of detergent product which can be a difficult and time consuming procedure.

Unit dose detergent products in the form of a pouch are known. For example EP0158464, U.S. Pat. Nos. 4,846,992, 4,886,615, 4,929,380 and 6,037,319 relate to a detergent pouch. Multi-compartment pouches are also known. For example, EP0236136 relates to a multi-compartment pouch. U.S. Pat. No. 4,973,410 relates to a pouch containing an aqueous liquid laundry detergent comprising alkanolamine which acts as an organic neutralisation system to improve product stability and detergent performance.

It is also known to use a multi-compartment pouch to separate bleach from solid ingredients which have a high moisture content. For example, EP0414463 relates to a multi-compartment pouch containing particulate sodium percarbonate and optionally other particulate materials in one compartment and powder ingredients containing a high free moisture content, for example aluminosilicates, in a different compartment.

However, pouches, or compartments of multi-compartment pouches, which contain a granular bleach composition, have a tendency to dispense bleach ingredients into the wash liquor in an uneven manner. For example, the bleach ingredients may be dispensed in a manner such that results in areas of the wash liquor having a high level of bleach activity, which increases the risk of patchy damage occurring to fabrics. This is especially true when the multi-compartment pouch is added directly to the drum of an automatic washing machine.

The inventors have overcome the above problem associated with the dispensing of a composition comprising a bleach ingredient from a multi-compartment pouch, by providing a composition in a water-soluble pouch, said pouch comprises at least two compartments, each compartment contains a different component of said composition, wherein a first compartment contains a first component which comprises a liquid matrix and a source of peracid.

The inventors have found that it is the source of peracid that is the problem and the inventors have found that if the source of peracid is either dissolved in a liquid, and/or is in the form of a suspended particle, then the source of peracid is more evenly dispensed from a compartment of a multi-compartment pouch, and do not remain in said compartment, or give rise to areas of increased bleach activity.

The multi-compartment pouch of the present invention also has the advantages described above, for example, enabling the source of peracid and peracid incompatible ingredients to be contained in different compartments of the pouch to increase the stability of said ingredients during storage, and to maintain the performance of the composition contained in the multi-compartment pouch.

SUMMARY OF THE INVENTION

A first embodiment of the present invention provides a composition in a water-soluble pouch, said pouch comprises at least two compartments, and each compartment contains a different component of said composition, wherein a first compartment contains a first component and said first component comprises a liquid matrix and a source of peracid.

A second embodiment of the present invention provides a use of a composition in a water-soluble pouch, said pouch comprises at least two compartments, and each compartment contains a different component of said composition, wherein a first compartment contains a first component and said first component comprises a liquid matrix and a source of peracid, in a laundry process.

DETAILED DESCRIPTION OF THE INVENTION

Pouch and Material Thereof

The water-soluble pouch of the invention, herein referred to as "pouch", comprises at least two compartments. Each compartment contains a different component of a composition. Said composition and components thereof are described in more detail hereinafter.

The pouch herein is typically a closed structure, made of materials described herein, enclosing a volume space which is separated into at least two, preferably two compartments. The pouch can be of any form, shape and material which is suitable to hold the composition, e.g. without allowing the release of the composition from the pouch prior to contact of the pouch to water. The exact execution will depend on, for example, the type and amount of the composition in the pouch, the number of compartments in the pouch, the characteristics required from the pouch to hold, protect and deliver or release the composition and/or components thereof.

The pouch may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load.

The pouch is typically made from a water-soluble material, preferably a water-soluble material, which encloses an inner volume space, said inner volume space is divided into the compartments of the pouch. Said inner volume space of the pouch is preferably enclosed by a water-soluble material in such a manner that the inner volume space is separated from the outside environment.

The composition, or components thereof, are contained in the volume space of the pouch, and are typically separated from the outside environment by a barrier of water-soluble material. Typically, different components of the composition which are contained in different compartments of the pouch, are separated from each other by a barrier of water-soluble material.

The term "separated" means for the purpose of this invention "physically distinct, in that a first ingredient comprised by a compartment is prevented from contacting a second ingredient if said second ingredient is not comprised by the same compartment which comprises said first ingredient".

The term "outside environment" means for the purpose of this invention "anything which is not contained within the pouch or compartment thereof, and is not part of the pouch or compartment thereof".

The compartment is suitable to hold the component of the composition, e.g. without allowing the release of the component from the compartment prior to contact of the pouch to water. The compartment can have any form or shape, depending on the nature of the material of the compartment, the nature of the component or composition, and the intended use and amount of the component or composition.

The compartments of the pouch may be of a different colour from each other, for example a first compartment may be green or blue, and a second compartment may be white or yellow. One compartment of the pouch may be opaque or semi-opaque, and a second compartment of the pouch may be translucent, transparent, or semi-transparent. The compartments of the pouch may be the same size, having the same internal volume, or may be different sizes having different internal volumes.

It may be preferred that the compartment which contains a component which is liquid, also contains an air bubble, preferably the air bubble has a volume of no more than 50%, more preferably no more than 40%, more preferably no more than 30%, more preferably no more than 20%, more preferably no more than 10%, more preferably no more than 5% of the volume space of said compartment. Without wishing to be bound by theory, it is believed that the presence of the air bubble increases the tolerance of the compartment to the movement of a liquid component within the compartment, thus reducing the risk of the liquid component leaking from the compartment.

The pouch is preferably made from a water-soluble material, herein referred to as "pouch material". The pouch itself, and typically the pouch material, is typically water-dispersible and has a water-dispersibility of at least 50%, preferably at least 75% or even at least 95%, as measured by the gravimetric method set out hereinafter, using a glass-filter with a maximum pore size of 50 microns.

The pouch itself, and preferably the pouch material, is water-soluble, and has a water-solubility of at least 50%, preferably at least 75% or even at least 95%, as measured by the method set out hereinafter using a glass-filter with a maximum pore size of 20 microns, namely:

Gravimetric method for determining water-dispersibility and water-solubility of the material of the pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 20 or 50 micron). The water is dried off from the collected filtrate by any conventional method, and the weight of the remaining material is determined (which is the dissolved or dispersed fraction). Then, the % solubility or dispersability can be calculated.

Preferred pouch materials are polymeric materials, preferably polymers which are formed into a film or sheet. The pouch material can, for example, be obtained by casting, blow-moulding, extrusion or blow extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

The polymer can have any weight average molecular weight, preferably from about 1000 to 1,000,000, or even from 10,000 to 300,000 or even from 15,000 to 200,000 or even from 20,000 to 150,000.

Mixtures of polymers can also be used as the pouch material. This may in particular be beneficial to control the mechanical and/or dissolution properties of the compartments or pouch, depending on the application thereof and the required needs. For example, it may be preferred that a mixture of polymers is present in the pouch material, whereby one polymer has a higher water-solubility than another polymer, and/or one polymer has a higher mechanical strength than another polymer. It may be preferred that a mixture of polymers is used, having different weight average molecular weights, for example a mixture of PVA or a copolymer thereof of a weight average molecular weight of 10,000-40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1-35% by weight polylactide and approximately from 65% to 99% by weight polyvinyl alcohol, if the material is to be water-soluble.

It may be preferred that the polymer present in the pouch material is from 60% to 98% hydrolysed, preferably 80% to 90%, to improve the dissolution of the material.

Most preferred pouch materials are films which comprise a PVA polymer with similar properties to the film which comprises a PVA polymer and is known under the trade reference M8630, as sold by Chris-Craft Industrial Products of Gary, Ind., US. Other preferred films suitable for use herein have similar properties to films that are known under the trade reference PT film or the K-series of films supplied by Aicello, or VF-HP film supplied by Kuraray.

The pouch material herein may comprise other additive ingredients than a polymer. For example, it may be beneficial to add plasticisers, for example glycerol, ethylene glycol, diethyleneglycol, propylene glycol, sorbitol and mixtures thereof, additional water, disintegrating aids. It may be useful when the pouched composition is a detergent composition, that the pouch material itself comprises a detergent additive to be delivered to the wash water, for example organic polymeric soil release agents, dispersants, dye transfer inhibitors.

The pouch can be prepared according to the known methods in the art. More specifically, the pouch is typically prepared by first cutting an appropriately sized piece of pouch material, preferably the pouch material is in the form of a film. The pouch material is then typically folded to form the necessary number and size of compartments and the edges are sealed using any suitable technology, for example heat sealing, wet sealing or pressure sealing. In a preferred embodiment, a sealing source is contacted to the pouch material and heat or pressure is applied to the pouch material, and the pouch material is sealed.

The pouch material is typically fitted around a mould and vacuum pulled so that it is flush with the inner surface of the mould, thus forming a vacuum formed indent or niche in said pouch material. Preferably, the pouch material is introduced to a mould, and a vacuum is applied to the mould, so that the pouch material adopts the shape of the mould, also referred to as vacuum-forming.

Another preferred method is thermo-forming to get the pouch material to adopt the shape of the mould. Thermo-forming typically involves the step of formation of an open pouch in a mould under application of heat, which allows the pouch material to take on the shape of the mould.

Typically more than one piece of pouch material is used to make the pouch. For example, a first piece of pouch material may be vacuum pulled into the mould so that said pouch material is flush with the inner walls of the mould. A second piece of pouch material may be positioned such that it at least partially overlaps, preferably completely overlaps, with the first piece of pouch material. The first piece of pouch material and second piece of pouch material are sealed together. The first piece of pouch material and second piece of pouch material can be the same type of material or can be different types of material.

In a preferred process to make the pouch, a piece of pouch material is folded at least twice, or at least three pieces of pouch material are used, or at least two pieces of pouch material are used wherein at least one piece of pouch material is folded at least once. The third piece of pouch material, or a folded piece of pouch material, creates a barrier layer that, when the sachet is sealed, divides the internal volume of said sachet into at least two or more compartments.

The pouch can also be prepared by fitting a first piece of the pouch material into a mould, for example the first piece of film may be vacuum pulled into the mould so that said film is flush with the inner walls of the mould. A composition, or component thereof, is typically poured into the mould. A pre-sealed compartment made of pouch material, is then typically placed over the mould containing the composition, or component thereof. The pre-sealed compartment preferably contains a composition, or component thereof. The pre-sealed compartment and said first piece of pouch material may be sealed together to form the pouch.

Source of Peracid

The source of peracid herein is any source capable of releasing peracid into the wash liquor upon dispensing of the composition from the pouch. The source of peracid may be a peracid or may be capable of forming peracid in-situ either in the compartment of then pouch during storage, or in the wash liquor upon dissolution of the composition from the pouch. The source of peracid may require activation by, contact with, interaction with a second molecule, for example a source of peroxide or water, before peracid is formed from, or released by, the source of peracid. For example, the source of peracid may be a peracid precursor, such as TAED, or may be a pre-formed peracid, such as PAP. Peracid precursors and pre-formed peracids are described in more detail hereinafter.

The source of peracid is either dissolved and/or suspended in the liquid matrix of the first component of the composition. The first component of the composition is described in more detail hereinafter. Preferably, the source of peracid is in the form of a suspended particle.

The source of peracid is preferably contained in a different compartment from peracid incompatible ingredients. These peracid incompatible ingredients are described in more detail hereinafter.

It may be preferred that the source of peracid is contained in a different compartment to other optional bleaching ingredients and bleach auxiliary ingredients. Optional bleaching ingredients and bleach auxiliary ingredients are described in more detail hereinafter. This prevents the optional bleach ingredients and bleach auxiliary reagents from interacting with each, and activating, the source of peracid, before the composition is dispensed to the wash liquor.

Peracid Precursor

The source of peracid preferably comprises a peracid precursor. Preferred peracid precursors are peroxyacid bleach precursors, perbenzoic acid precursors and derivatives thereof, cationic peroxyacid precursors, alkyl percarboxylic acid bleach precursors, amide substituted alkyl peroxyacid precursors and combinations thereof.

It may be preferred that the composition and/or the first component thereof, comprises at least two peroxyacid bleach precursors, preferably at least one hydrophobic peroxyacid bleach precursor and at least one hydrophilic peroxy acid bleach precursor.

It may even be preferred for a second component of the composition to comprise a peracid precursor, which is in addition to the peracid precursor comprised by the first component of the composition. The peracid precursor of the second component may be a different type of peracid precursor to the peracid precursor of the first component, or may the same type of peracid precursor to the peracid precursor of the first component. Preferably, if present, the peracid precursor of the second component is a different type to the peracid precursor of the first component. For example, the peracid precursor of the first component may be a hydrophilic peracid precursor and the peracid precursor of the second component may be a hydrophobic peracid precursor, or vice versa. This allows greater flexibility in the formulation of the composition and may also reduce the instability of the composition, and the peracid precursors comprised therein.

The peroxy acid bleach precursor preferably comprises a compound having a oxy-benzene sulphonate group, preferably nonanoyl oxy benzene sulphonate (NOBS), sodium 3,5,5-tri-methyl hexanoyloxybenzene sulfonate (iso-NOBS), benzoyl oxy benzene sulphonate (BOBS), decanoyl oxy benzene sulphonate (DOBS), dodecanoyl oxy benzene sulphonate (DDOBS) and/or nonanoyl amido caproic oxy benzene sulphonate (NAC-OBS). Other preferred peroxy acid bleach precursor preferably comprises tetraacetyl ethylene diamine (TAED).

Peroxyacid Bleach Precursor

Peroxyacid bleach precursors are compounds which react with hydrogen peroxide in a perhydrolysis reaction to produce a peroxyacid. Generally peroxyacid bleach precursors may be represented by the general formula:

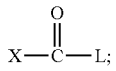

wherein, L is a leaving group, and X is essentially any functionality, such that on perhydrolysis the structure of the peroxyacid produced has the general formula:

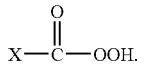

Peroxyacid bleach precursors are preferably incorporated at a level of from 0.1% to 20% by weight, more preferably from 1% to 10% by weight, most preferably from 1.5% to 5% by weight of the composition.

Suitable peroxyacid bleach precursors typically contain one or more N- or O-acyl groups. These precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter defined as "L group", must be sufficiently reactive for the perhydrolysis reaction to occur within the optimum time frame: for example, a wash cycle. However, if the L group is too reactive, this peracid source will be difficult to stabilise for use in the composition.

Preferred L groups are selected from the group consisting of:

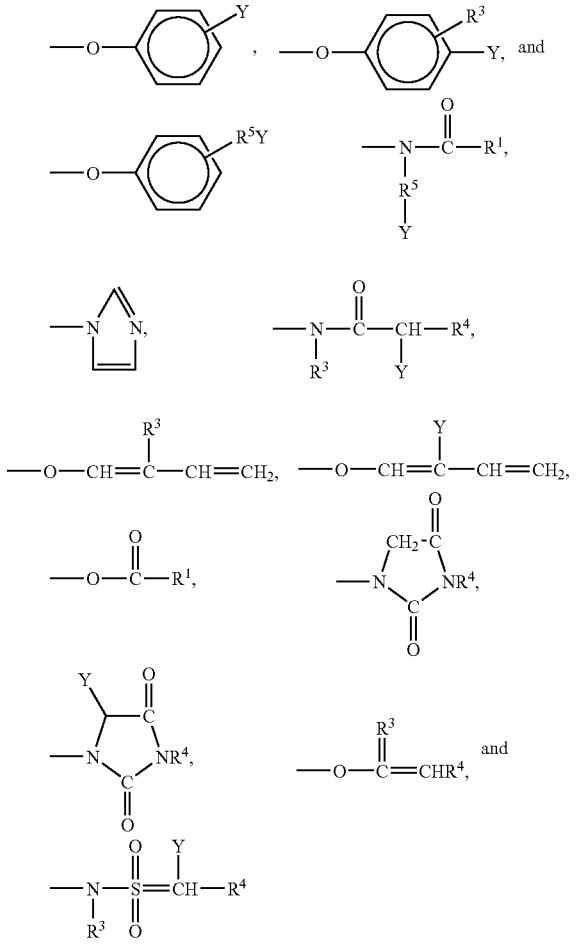

and mixtures thereof, wherein: $R^1$ is an alkyl, aryl, or alkaryl group containing from 1 to 14 carbon atoms; $R^3$ is an alkyl chain containing from 1 to 8 carbon atoms; $R^4$ is H or $R^3$; $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein: $R^3$ is an alkyl chain containing from 1 to 4 carbon atoms; M is a cation which provides solubility to the bleach activator; and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Perbenzoic Acid Precursor

Perbenzoic acid precursor compounds provide perbenzoic acid on perhydrolysis.

Suitable O-acylated perbenzoic acid precursor compounds include the substituted and unsubstituted benzoyl oxybenzene sulfonates, including for example benzoyl oxybenzene sulfonate:

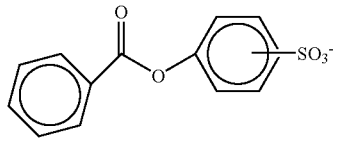

Also suitable are the benzoylation products of sorbitol, glucose, and all saccharides with benzoylating agents, including for example:

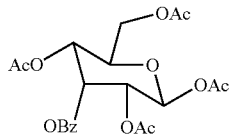

Wherein: Ac=COCH3; and Bz=Benzoyl.

Perbenzoic acid precursor compounds of the imide type include N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole and other useful N-acyl group-containing perbenzoic acid precursors include N-benzoyl pyrrolidone, dibenzoyl taurine and benzoyl pyroglutamic acid.

Other perbenzoic acid precursors include the benzoyl diacyl peroxides, the benzoyl tetraacyl peroxides, and the compound having the formula:

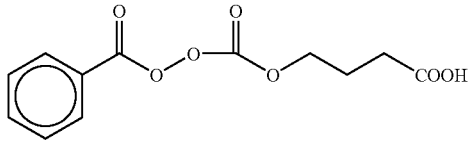

Phthalic anhydride is another suitable perbenzoic acid precursor compound herein:

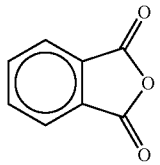

Suitable N-acylated lactam perbenzoic acid precursors have the formula:

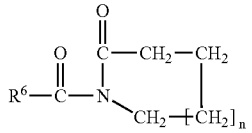

wherein n is from 0 to 8, preferably from 0 to 2, and $R^6$ is a benzoyl group.

Perbenzoic Acid Derivative Precursors

Perbenzoic acid derivative precursors provide substituted perbenzoic acids on perhydrolysis.

Suitable substituted perbenzoic acid derivative precursors include any of the herein disclosed perbenzoic precursors in which the benzoyl group is substituted by essentially any non-positively charged (i.e. non-cationic) functional group including, for example alkyl, hydroxy, alkoxy, halogen, amine, nitrosyl and amide groups.

A preferred class of substituted perbenzoic acid precursor compounds are the amide substituted compounds of the following general formulae:

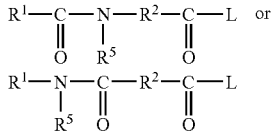

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms. $R^2$ preferably contains from 4 to 8 carbon atoms. $R^1$ may be aryl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter Cationic peroxyacid precursors are described in patents U.S. Pat. Nos. 4,904,406; 4,751,015; 4,988,451; 4,397,757; 5,269,962; 5,127,852; 5,093,022; 5,106,528; GB1,382,594; EP475,512, EP458,396; EP284,292; and JP87-318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

A preferred cationically substituted benzoyl oxybenzene sulfonate is the 4-(trimethyl ammonium) methyl derivative of benzoyl oxybenzene sulfonate:

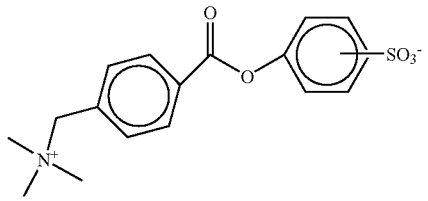

A preferred cationically substituted alkyl oxybenzene sulfonate has the formula:

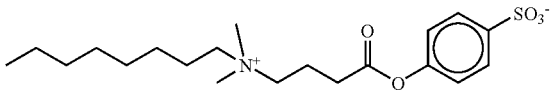

Preferred cationic peroxyacid precursors of the N-acylated caprolactam class include the trialkyl ammonium methylene benzoyl caprolactams, particularly trimethyl ammonium methylene benzoyl caprolactam:

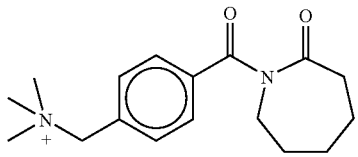

Other preferred cationic peroxyacid precursors of the N-acylated caprolactam class include the trialkyl ammonium methylene alkyl caprolactams:

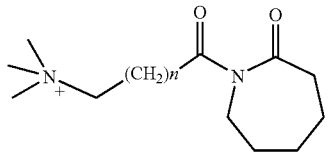

where n is from 0 to 12, particularly from 1 to 5.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the N-,N,$N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose.

Amide Substituted Alkyl Peroxyacid Precursors

Amide substituted alkyl peroxyacid precursor compounds are also suitable, including those of the following general formulae:

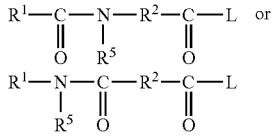

wherein: $R^1$ is an alkyl group with from 1 to 14 carbon atoms; $R^2$ is an alkylene group containing from 1 to 14 carbon atoms; and $R^5$ is H or an alkyl group containing 1 to 10 carbon atoms; and L can be essentially any leaving group. $R^1$ preferably contains from 6 to 12 carbon atoms. $R^2$ preferably contains from 4 to 8 carbon atoms. $R^1$ may be straight chain or branched alkyl containing branching, substitution, or both and may be sourced from either synthetic sources or natural sources including for example, tallow fat. Analogous structural variations are permissible for $R^2$. The substitution can include alkyl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in Patent EP-A-0170386.

Benzoxazin Organic Peroxyacid Precursors

Also suitable are precursor compounds of the benzoxazin-type, as disclosed for example in patents EP-A-332,294 and EP-A-482,807, particularly those having the formula:

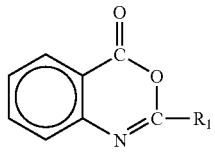

including the substituted benzoxazins of the type

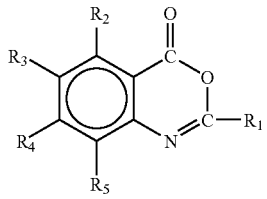

wherein $R_1$ is H, alkyl, alkaryl, aryl, arylalkyl, and wherein $R_2$, $R_3$, $R_4$, and $R_5$ may be the same or different substituents selected from H, halogen, alkyl, alkenyl, aryl, hydroxyl, alkoxyl, amino, alkyl amino, $COOR_6$ (wherein $R_6$ is H or an alkyl group) and carbonyl functions.

An especially preferred precursor of the benzoxazin-type is:

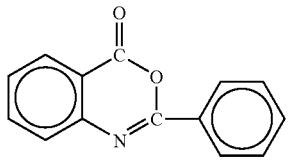

Pre-formed Peracid

The source of peracid preferably comprises a pre-formed peracid, the pre-formed peracid is typically an organic peroxyacid compound, which is capable of acting as a bleaching system.

A preferred class of organic peroxyacid compounds are the amide substituted compounds of the following general formulae:

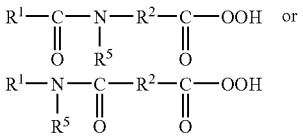

wherein: $R^1$ is an alkyl, aryl or alkaryl group with from 1 to 14 carbon atoms; $R^2$ is an alkylene, arylene, and alkarylene group containing from 1 to 14 carbon atoms; and $R^5$ is H or an alkyl, aryl, or alkaryl group containing 1 to 10 carbon atoms. $R^1$ preferably contains from 6 to 12 carbon atoms. $R^2$ preferably contains from 4 to 8 carbon atoms. $R^1$ may be straight chain or branched alkyl, substituted aryl or alkylaryl containing branching, substitution, or both and may be sourced from either synthetic sources or natural sources including for example, tallow fat. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted organic peroxyacid compounds of this type are described in EP-A-0170386.

Preferred pre-formed peracids are pre-formed mono peracids, meaning that the peracid contains one peroxygen group. Preferred pre-formed mono peracids are monoperoxycarboxylic acids.

In a preferred embodiment of the present invention the pre-formed peracid has the general formula

X—R—C(O)OOH wherein: R is a linear or branched alkyl chain having at least 1 carbon atom; and X is hydrogen or a substituent group selected from the group consisting of alkyl, especially alkyl chains of from 1 to 24 carbon atoms, aryl, halogen, ester, ether, amine, amide, substituted phthalic amino, imide, hydroxide, sulphide, sulphate, sulphonate, carboxylic, heterocyclic, nitrate, aldehyde, phosphonate, phosphonic or mixtures thereof.

More particularly the R group preferably comprises up to 24 carbon atoms. Alternatively, the R group may be a branched alkyl chain comprising one or more side chains which comprise substituent groups selected from the group consisting of aryl, halogen, ester, ether, amine, amide, substituted phthalic amino, imide, hydroxide, sulphide, sulphate, sulphonate, carboxylic, heterocyclic, nitrate, aldehyde, ketone or mixtures thereof.

In a preferred pre-formed peracid the X group, according to the above general formula, is a phthalimido group. Thus, particularly preferred pre-formed peracids are those having general formula:

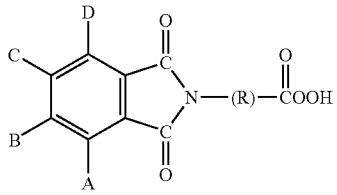

where R is $C_{1-20}$ and where A, B, C and D are independently either hydrogen or substituent groups individually selected from the group consisting of alkyl, hydroxyl, nitro, halogen, amine, ammonium, cyanide, carboxylic, sulphate, sulphonate, aldehydes or mixtures thereof.

In a preferred aspect of the present invention R is an alkyl group having from 3 to 12 carbon atoms, more preferably from 5 to 9 carbon atoms. Preferred substituent groups A, B, C and D are linear or branched alkyl groups having from 1 to 5 carbon atoms, but more preferably hydrogen.

Preferred pre-formed peracids are selected from the group consisting of phthaloyl amido peroxy hexanoic acid (PAP), phthaloyl amido peroxy heptanoic acid, phthaloyl amido peroxy octanoic acid, phthaloyl amido peroxy nonanoic acid, phthaloyl amido peroxy decanoic acid and mixtures thereof.

In a particularly preferred aspect of the present invention the peracid has the formula such that R is $C_5H_{10}$ (i.e. PAP).

If the first component of the composition comprises a source of peracid which is a pre-formed peracid, then the pH of the first component may be lower than the pH of the second component of the composition. In this embodiment of the present invention, preferably the first component has a pH in range of from 3.0 to 6.0, preferably from 4.0 to 5.0. In this embodiment of the present invention, the second component preferably comprises a source of alkalinity, for example a source of carbonate; such as sodium carbonate and/or sodium bicarbonate.

Composition and Components Thereof

The composition herein is contained within a pouch. The composition is made up of at least two components which are contained in different compartments of the pouch. These components of the composition are described in more detail hereinafter.

The compositions herein are cleaning compositions or fabric care compositions, preferably hard surface cleaners, more preferably laundry or dish washing compositions, including pre-treatment or soaking compositions and rinse additive compositions.

Typically, the composition comprises such an amount of a cleaning composition, that one or a multitude of the pouched compositions is or are sufficient for one wash.

First Component

The first component comprises a liquid matrix. Preferably the first component comprises (by weight of the first component) at least 20%, or even at least 30% liquid matrix, preferably at least 40%, or even at least 50%, or at least 60%, or at least 70%, or at least 80%, or even at least 90% liquid matrix. The first component may comprise dispersed and/or suspended solid particles, which are dispersed and/or suspended in the liquid matrix of the first component. For example, ingredients which do not readily dissolve in the liquid matrix of the first component may be present in the form of a suspended particle. These ingredients include the source of peracid herein. If present, the suspended particles are preferably uniformly dispersed throughout the liquid matrix, although it may also be preferred for these suspended particles to be dispersed in an uneven manner. It may also be preferred for all of the suspended particles to be suspended in only one region of the liquid matrix.

By liquid, or liquid matrix, it is typically meant being in liquid form at ambient temperature and pressure, for example at 20° C. and atmospheric pressure.

The first component preferably comprises a viscous liquid matrix, preferably having a viscosity of at least 300 mPas, more preferably at least 400 mPas, more preferably at least 500 mPas, more preferably at least 750 mPas, more preferably at least 1000 mPas, more preferably at least 1500 mPas, more preferably at least 2000 mPas, more preferably at least 5000 mPas, or at least 10000 mPAs, or at least 25000 mPas, or at least 50000 mPas. This is especially preferred if the source of peracid is in the form of a suspended particle, and further reduces the risk of patchy damage occurring to fabric, compared to when the source of peracid is suspended or dispersed in a non-viscous liquid matrix.

Without wishing to be bound by theory, it is believed that the viscous liquid matrix enables the suspended source of peracid to remain adequately dispersed or suspended in the liquid matrix of the first component, and prevents the source of peracid from forming large solid complexes, which, when dispersed from the pouch during the washing process, may settle onto the fabric in the wash load and give rise to an increased risk in patchy damage.

The viscosity of the viscous liquid matrix is typically measured at a shear rate of from 20 s-1 to 50 s1, preferably 25 s1 or 25 s1 to 50 s1. The skilled person will know to use a shear rate outside of this range if the rheology of the viscous liquid is such that the viscosity of said liquid can not be accurately measured at a shear rate within this range. The viscous liquid matrix may also have a yield stress of from 10 $Nm^{-2}$ to 200 $Nm^{-2}$.

The liquid matrix of the first component may be non-aqueous, preferably comprising less than 1% or less than 0.5% free water. The first component may comprise (by weight of the first component) less than 5% free water, preferably less than 4%, or less than 3%, or less than 2%, or less than 1%, or less than 0.5% free water.

The liquid matrix of the first component may comprise a solvent. Preferred solvents do not dissolve or damage the pouch material. More preferably the solvent is a long chain, low polarity solvent. By long chain it is meant solvents comprising a carbon chain of greater than 6 carbon atoms and by low polarity it is meant a solvent having a dielectric constant of less than 40. Preferred solvents include $C_{12-14}$ paraffin and more preferably $C_{12-14}$ iso-paraffin. Other solvents include alcohols such as methanol, ethanol, propanol, iso-propanol, derivatives thereof and combinations thereof. Other solvents suitable for use herein include diols. Other solvents suitable for use herein include glycerol, di-propylene glycol, butyl alcohol, butoxy-propoxy propanol, paraffin oil and 2 amino-2 methyl propanol, and combinations thereof.

The first component is preferably free from peracid incompatible ingredients. Peracid incompatible ingredients are described hereinafter. This increases the stability of the composition, components thereof and ingredients thereof, since the source of peracid is contained separately from the peracid incompatible ingredients, preventing the peracid source and incompatible ingredients from interacting with each other, thus avoiding one or more of these ingredients, and/or the source of peracid itself, being degraded, destroyed and/or inactivated during storage of the composition in the water-soluble pouch.

Second Component

The second component of the composition is contained in a different compartment of the pouch to the first component of the composition.

Preferably the second component comprises a bleach incompatible ingredient. The bleach incompatible ingredient is described in more detail hereinafter. Preferably the second component is free from a source of peracid.

Preferably the second compartment which comprises a bleach incompatible ingredient, preferably where the bleach incompatible ingredient is deactivated or destroyed by the source of peracid, is made of pouch material which more readily dissolves compared to the pouch material which forms the first compartment which contains the first component. For example, the pouch material of the second compartment may be thinner than the pouch material of the first compartment. Or the pouch material of the second material may be coated with a coating which promotes or enhances the water-dispersability or water-solubility of the pouch material. Or the pouch material of the first component may be coated with a coating that reduces the water-solubility of the pouch material. This enables the second compartment to dissolve or disperse faster than the first compartment, to enable the second component to be dispensed into the wash liquor before the first component.

The sequential release of components of the composition increases the cleaning performance of the composition. This is especially preferred if the second component comprises a bleach incompatible ingredient, since the bleach incompatible ingredient is dispensed into the wash liquor and is able to start functioning before the bleaching ingredient is dispensed into the wash liquor. Bleach incompatible ingredients are described in more detail hereinafter.

If the bleach incompatible ingredient degrades, destroys or inactivates the bleaching ingredient, then the reverse is preferred and the first compartment and/or second compartment is preferably treated such that the first component is dispensed into the wash liquor before the second component. Preferably the second component is dispensed into the wash liquor at least 5 seconds before, more preferably at least 10 seconds, or at least 20 seconds, or at least 45 seconds, or at least 1 minute, or at least 3 minutes, or at least 5 minutes, or even at least 10 minutes, before the first component of the composition. Alternatively, preferably the first component is dispensed into the wash liquor at least 5 seconds before, more preferably at least 10 seconds, or at least 20 seconds, or at least 45 seconds, or at least 1 minute, or at least 3 minutes, or at least 5 minutes, or even at least 10 minutes, before the second component of the composition.

In this embodiment of the present invention, the component which is dispensed first into the wash liquor may preferably comprise other ingredients which it is beneficial to have acting in the wash liquor at the start of the washing cycle. For example, such ingredients include surfactants and builders, especially water-soluble builders. Also, if the composition herein comprises a fabric softening agent, it may be preferred that said fabric softening agent is comprised by the component of the composition which is dispersed into the wash liquor last. This improves the softening performance of the composition.

The second component may comprise a liquid matrix or a solid matrix. Preferably the second component comprises a liquid matrix. Preferably the second component comprises (by weight of the second component) at least 20%, or even at least 30% liquid matrix, preferably at least 40%, or even at least 50%, or at least 60%, or at least 70%, or at least 80%, or at least 80%, or even at least 90% liquid matrix. The second component may comprise as a liquid matrix, a solvent as described hereinabove. This solvent may be the same type of solvent as the solvent comprised by the first component, or may be a different type of solvent to the solvent comprised by the first component.

The second component preferably comprises an aqueous liquid matrix, and preferably comprises (by weight of the second component) from 1% free water, preferably from 2%, or from 3%, or from 4%, or from 5% free-water, and preferably comprises (by weight of the second component) to 25% free water, preferably to 20%, or to 15%, or to 10% water. If the first component comprises a non-aqueous liquid matrix, then preferably the second component comprises an aqueous liquid matrix. In this preferred embodiment of the present invention, ingredients which prefer, or are more easily formulated, in a non-aqueous environment, are preferably comprised by the first component of the composition, whilst ingredients which prefer, or are more easily formulated, in an aqueous environment, are preferably comprised by the second component of the composition.

The second component preferably comprises a low-viscous liquid matrix, preferably having a viscosity of less than 300 mPas, preferably less than 200 mPas, or less than 100 mPas, or less than 50 mPas, or less than 25 mPas. This is especially preferred if the first component comprises a viscous liquid matrix.

The viscosity of the low-viscous liquid matrix is typically measured at a shear rate of from 20 $s^{-1}$ to 50 $s^{-1}$, preferably 25 $s^{-1}$ or 25 $s^{-1}$ to 50 $s^{-1}$. The skilled person will know to use a shear rate outside of this range if the rheology of the low-viscous liquid is such that the viscosity of said liquid can not be accurately measured at a shear rate within this range.

The second component may also comprise a source of peracid and/or optional bleaching ingredients and bleach auxiliary ingredients. Preferably the bleaching ingredient of the second component is a different type of bleaching ingredient to the source of peracid and/or other optional bleaching ingredients and bleach auxiliary ingredients of the first component. Preferably, the peracid source and other optional bleaching ingredients and bleach auxiliary ingredients of the first component and the bleaching ingredient of the second component, when contacted together, form an activated bleaching system, especially when in an aqueous and/or oxidative environment.

Since these bleaching ingredient are comprised by different components of the composition, and contained in different compartments of the pouch, then the level of bleach activity of the bleaching system of the composition, is reduced, at least initially, until these bleaching ingredients are dispersed such that they come into contact with each other. Since, at this stage of the washing cycle, the bleaching ingredient is already adequately dispersed, then the risk of patchy damage occurring to fabrics in the wash load is reduced. The bleaching ingredients may be sequentially released as described hereinbefore, to further reduce the risk of patchy damage occurring to fabric.

A preferred embodiment of the present invention is a composition, wherein the second component comprises a peracid incompatible ingredient, preferably selected from the group consisting of enzyme, perfume, chelant or combinations thereof. This reduces the instability of the peracid incompatible ingredient and may reduce the instability of the source of peracid, and improves the performance of the composition herein.

Another preferred embodiment of the present invention is a composition, wherein the second component comprises a bleach auxiliary ingredient, preferably selected from the group consisting of bleach booster, bleach catalyst or combinations thereof. This reduces the instability of the bleach system of the composition during storage.

Optional Ingredients

The composition and components thereof may comprise a variety of different ingredients including builder compounds, surfactants, enzymes, alkalinity sources, colourants, perfume, lime soap dispersants, organic polymeric compounds including polymeric dye transfer inhibiting agents, crystal growth inhibitors, heavy metal ion sequestrants, metal ion salts, enzyme stabilisers, corrosion inhibitors, suds suppressers, solvents, fabric softening agents, optical brighteners and hydrotropes.

The preferred amounts of ingredients described herein are % by weight of the composition herein as a whole.

Optional Bleach Ingredients and Bleach Auxiliary Ingredients

Source of Peroxide

The source of peroxide is typically a hydrogen peroxide source. Suitable hydrogen peroxide sources include the inorganic perhydrate salts.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred embodiments utilize a coated form of the inorganic perhydrate salt which provides better storage stability for the perhydrate salt.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for use herein. Sodium percarbonate is an addition compound having a formula corresponding to $2Na_2CO_3.3H_2O_2$, and is available commercially as a crystalline solid. The percarbonate is most preferably in a coated form which provides in-product stability.

A suitable coating material providing in product stability comprises a salt of a water soluble alkali metal, or mixtures thereof. For example salts of sulphate and/or carbonate. Such coatings together with coating processes have previously been described, for example in GB-1,466,799, granted to Interox on 9th Mar. 1977. The weight ratio of the coating material to percarbonate lies in the range from 1:200 to 1:4, more preferably from 1:99 to 1:9, and most preferably from 1:49 to 1:19.

Another suitable coating material providing in product stability, comprises sodium silicate of $SiO_2$:$Na_2O$ ratio from 1.8:1 to 3.0:1, preferably 1.8:1 to 2.4:1, and/or sodium metasilicate, preferably applied at a level of from 2% to 10%, (normally from 3% to 5%) of $SiO_2$ by weight of the inorganic perhydrate salt. Magnesium silicate can also be included in the coating. Coatings that contain silicate salts or other inorganics are also suitable.

Bleach Catalyst

The composition herein may comprise a bleach catalyst. The term "bleach catalyst" used herein includes compounds which are catalytic bleach boosters. Preferably the bleach catalyst is a metal containing bleach catalyst, more preferably a transition metal containing bleach catalyst, and even more preferably a manganese or cobalt-containing bleach catalyst.

The compositions of the present invention may comprise an effective amount of a bleach catalyst. The term "an effective amount" is defined as "an amount of the bleach catalyst present in the compositions, or during use, that is sufficient, under whatever comparative or use conditions are employed, to result in at least partial oxidation of the material sought to be oxidized by the composition or method." Preferably the compositions of the present invention comprise from 1 ppb (0.0000001%), more preferably from 100 ppb (0.00001%), yet more preferably from 500 ppb (0.00005%), still more preferably from 1 ppm (0.0001%) to 99.9%, more preferably to 50%, yet more preferably to 5%, still more preferably to 500 ppm (0.05%) by weight of the composition, of a bleach catalyst as described herein below.

Preferred types of bleach catalysts include manganese-based complexes. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof.

Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato)bispyridylamine-cobalt (II), trisdipyridylamine-cobalt(II) perchlorate, Co(2,2-bispyridylamine)$_2$ $O_2ClO_4$, Bis-(2,2'-bispyridylamine) copper(II) perchlorate, tris(di-2-pyridylamine) iron(II) perchlorate, and mixtures thereof. Preferred examples include binuclear Mn complexes with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]\text{-}(ClO_4)_3$.

The most preferred cobalt catalyst useful herein are cobalt pentaamine acetate salts having the formula $[Co(NH_3)_5OAc]\ T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC").

Other suitable bleach catalysts include transition-metal bleach catalyst comprising:

i) a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV), preferably Mn(II), Mn(III), Mn(IV), Fe(II), Fe(III), Fe(IV), Cr(II), Cr(III), Cr(IV), Cr(V), Cr(VI), and mixtures thereof;

ii) a cross-bridged macropolycyclic ligand being coordinated by four or five donor atoms to the same transition metal, said ligand comprising:

a) an organic macrocycle ring containing four or more donor atoms (preferably at least 3, more preferably at least 4, of these donor atoms are N) separated from each other by covalent linkages of 2 or 3 non-donor atoms, two to five (preferably three to four, more preferably four) of these donor atoms being coordinated to the same transition metal atom in the complex;

b) a cross-bridged chain which covalently connects at least 2 non-adjacent donor atoms of the organic macrocycle ring, said covalently connected non-adjacent donor atoms being bridgehead donor atoms which are coordinated to the same transition metal in the complex, and wherein said cross-bridged chain comprises from 2 to about 10 atoms (preferably the cross-bridged chain is selected from 2, 3 or 4 non-donor atoms, and 4-6 non-donor atoms with a further donor atom); and iii) optionally, one or more non-macropolycyclic ligands, preferably selected from the group consisting of $H_2O$, ROH, $NR_3$, RCN, $OH^-$, $OOH^-$, $RS^-$, $RO^-$, $RCOO^-$, $OCN^-$, $SCN^-$, $N_3^-$, $CN^-$, $F^-$, $Cl^-$, $Br^-$, $I^-$, $O_2^-$, $NO_3^-$, $NO_2^-$, $SO_4^{2-}$, $SO_3^{2-}$, $PO_4^{3-}$, organic phosphates, organic phosphonates, organic sulfates, organic sulfonates, and aromatic N donors such as pyridines, pyrazines, pyrazoles, imidazoles, benzimidazoles, pyrimidines, triazoles and thiazoles with R being H, optionally substituted alkyl, optionally substituted aryl.

A particularly useful bleach catalyst is [Mn(Bcyclam) Cl2]:

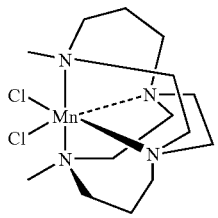

"Bcyclam" (5,12-dimethyl-1,5,8,12-tetraaza-bicyclo [6.6.2]hexadecane) is prepared according to J. Amer. Chem. Soc., (1990), 112, 8604.

The bleach catalysts herein may be co-processed with adjunct materials so as to reduce the colour impact if desired for the aesthetics of the product, or to be included in enzyme-containing particles as exemplified hereinafter, or the compositions may be manufactured to contain catalyst "speckles".

Other preferred bleach catalysts are compounds which form complexes with transition metals, and catalyze the bleaching of a substrate by reacting with the atmospheric oxygen in the wash liquor. A preferred bleach catalyst of this type have the general formula]:

$$[M_aL_kX_n]Y_m$$

wherein:

a is an integer from 1 to 10, preferably 1 to 4;

k is an is an integer from 1 to 10;

n is an integer from 1 to 10, preferably 1 to 4;

m is zero or an integer from 1 to 20, preferably 1 to 4;

M is a metal selected Mn(II)-(III)-(IV)-(V), Cu(I)-(II)-(III), Fe(II)-(III)-(IV)-(V), Co(I)-(II)-(III), Ti(II)-(III)-(IV), V(II)-(III)-(IV)-(V), Mo(II)-(III)-(IV)-(V)-(VI) and W(IV)-(V)-(VI), preferably selected from Fe(II)-(III)-(IV)-(V);

X represents a coordinating species selected from $O^{2-}$, $RBO_2^{2-}$, $RCOO^-$, $RCONR^-$, $OH^-$, $NO_3^-$, NO, $S^{2-}$, $RS^-$, $PO_4^{3-}$, $PO_3OR^{3-}$, $H_2O$, $CO_3^{2-}$, $HCO_3^-$, ROH, $N(R)_3$, $ROO^-$, $O_2^{2-}$, $O_2^-$, RCN, $Cl^-$, $Br^-$, $OCN^-$, $SCN^-$, $CN^-$, $N_3^-$, $F^-$, $I^-$, $RO^-$, $ClO_4^-$, and $CF_3SO_3^-$;

Y represents a non-coordinated counterion selected from $ClO_4^-$, $BR_4^-$, $[MX_4]^-$, $[MX_4]^{2-}$, $PF_6^-$, $RCOO^-$, $NO_3^-$, $RO^-$, $N^+(R)_4$, $ROO^-$, $O_2^{2-}$, $O_2^-$, $Cl^-$, $Br^-$, $F^-$, $I^-$, $CF_3SO_3^-$, $S_2O_6^{2-}$, $OCN^-$, $H_2O$ and $BF_4^-$;

each R is independently selected from hydrogen, hydroxyl, —R' and OR'; wherein R' is independently selected from alkyl, alkenyl, cycloalkyl, heterocycloalkyl, aryl, heteroaryl or a carbonyl derivative group; R' being optionally substituted with one or more functional groups E;

E is independently selected from F, Cl, Br, I, OH, OR', $HN_2$, NHR', $N(R')_2$, $N(R')_2$, $N(R')_3^+$, C(O)R', OC(O)R', COOH, $COO^-$ ($Na^+$, $K^+$), COOR', $C(O)NH_2$, C(O)NHR', $C(O)N(R')_2$, heteroaryl, R', SR', SH, P(R')2, P(O)(R')2, $P(O)(OH)_2$, $P(O)(OR')_2$, $NO_2$, $SO_3H$, $SO_3^-(Na^+, K^+)$, S(O)2R', HNC(O)R', and N(R')C(O)R';

L is a ligand having the general formula:

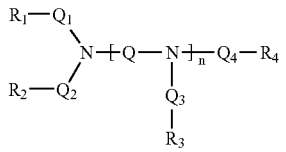

wherein:

n=1 or 2, whereby if n=2, then each Q3-R3 groups is independently defined;

R1, R2, R3, R4 are independently selected from the group consisting of hydrogen, hydroxyl, halogen, —NH—C(NH)—$NH_2$, —R and —OR, wherein R=alky(en)yl, cycloalkyl, heterocycloalkyl, aryl, heteroaryl or a carbonyl derivative group, R being optionally substituted by one or more functional groups E;

Q1, Q2, Q3, Q4 are independently selected from a group of structures having the formula:

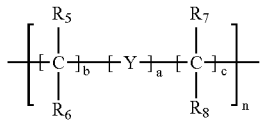

wherein a=0 to 5, b=0 to 5, c=0 to 5, n=1 or 2, and a+b+c=a number from 1 to 5;

Y is selected from the group consisting of O, S, SO, —$SO_2$—, C(O), arylene, alkylene, heteroarylene, heterocycloalkylene, (G)P, P(O), and (G)N, wherein G is selected from hydrogen, alkyl, aryl, arylalkyl, cycloalkyl, each except hydrogen being optionally substituted by one or more functional groups E;

R5, R6, R7 and R8 are independently selected from the group consisting of hydrogen, hydroxyl, halogen, —R and —OR;

R represents alkyl alkenyl, cycloalkyl, heterocycloalkyl, aryl, heteroaryl and a carbonyl derivative group being optionally substituted with one or more functional groups E; or R5 together with R6, or R7 together with R8, or both, represent oxygen; or R5 together with R7 and/or independently R6 together with R8; or R5 together with R8 and/or independently R6 together with R7, represent C1-6 alkylene optionally substituted with C1-4 alkyl, —F, —Cl, —Br, or —I; provided that at least two of R1, R2, R3, R4 comprise coordinating heteroatoms and no more than six heteroatoms are coordinated to the same transition metal atom;

Q is selected from —$(CH_2)_{2-4}$, —$CH_2CH(OH)CH_2$,

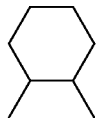

optionally substituted with methyl or ethyl,

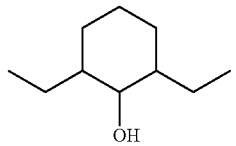

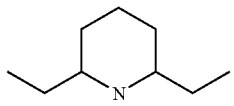

, and

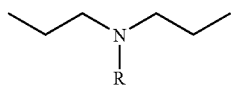

Bleach Boosters

Bleach boosters as defined herein include catalytic bleach booster compounds. Preferred bleach boosters suitable for use herein are described in U.S. Pat. No. 5,817,614.

Other preferred bleach boosters for use herein are quaternary imine salts described in EP728183. Preferred quaternary imine salts have the general formula:

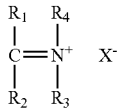

wherein;

$R_1$ and $R_4$ are hydrogen or a $C_1$-$C_{30}$ substituted or unsubstituted radical selected from the group consisting of phenyl, aryl, heterocyclic ring, alkyl and cycloalkyl radicals;

$R_2$ is hydrogen or a $C_1$-$C_{30}$ substituted or unsubstituted radical selected from the group consisting of phenyl, aryl, heterocyclic ring, alkyl, cycloalkyl, nitro, halo, alkoxy, keto, carboxylic and carboalkoxy radicals;

$R_3$ is a $C_1$-$C_{30}$ substituted or unsubstituted radical selected from the group consisting of phenyl, aryl, heterocyclic ring, alkyl, cycloalkyl, nitro, halo, and cyano radicals;

$R_1$ with $R_2$, and $R_2$ with $R_3$ respectively together form a cycloalkyl, polycyclo, heterocyclic or aromatic ring system;

$X^-$ is a counterion stable in the presence of oxidising agents.

Other preferred bleach boosters are sulfoimines having the following general formula:

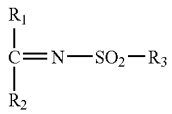

wherein:

R1 may be hydrogen or a substituted or unsubstituted phenyl, aryl, heterocyclic, alkyl or cycloalkyl group;

R2 may be hydrogen or a substituted or unsubstituted phenyl, aryl, heterocyclic, alkyl or cycloalkyl group or a keto, carboxylic, carboalkoxy or a R1C═N—SO2-R3 group;

R3 may be a substituted or unsubstituted phenyl, aryl, heterocyclic, alkyl or cycloalkyl group or a nitro, halo or cyano group;

R1 with R2 and/or R2 with R3 may respectively form a cycloalkyl, heterocyclic or aromatic ring system.

Other preferred bleach boosters are arylimium zwitterions having the following general formula:

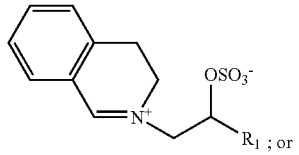

wherein $R_1$ is selected from the group consisting of hydrogen, and linear or branched $C_1$-$C_{18}$ substituted or unsubstituted alkyl chain; or having the general formula:

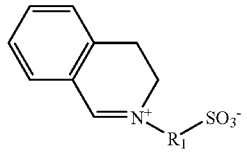

wherein $R_1$ is selected from the group consisting of a linear or branched $C_1$-$C_{18}$ substituted or unsubstituted alkyl chain.

Other preferred bleach boosters have the following general structure:

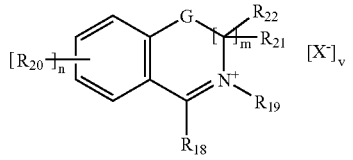

wherein:

the net charge is from +3 to −3;

m is 1 to 3 when G is present and m is 1 to 4 when G is not present;

n is an integer from 0 to 4;

each $R_{20}$ is independently selected from a substituted or unsubstituted radical selected from the group consisting of H, alkyl, cycloalkyl, aryl, fused aryl, heterocyclic ring, fused heterocyclic ring, nitro, halo, cyano, sulfanato, alkoxy, keto, carboxylic and carboalkoxy radicals, and any two vicinal $R_{20}$ substituents may combine to form a fused aryl, fused carbocyclic or fused heterocyclic ring;

$R_{18}$ may be a substituted or unsubstituted radical selected from the group consisting of H, alkyl, cycloalkyl, alkaryl, aryl, aralkyl, heterocyclic ring, silyl, nitro, halo, cyano, sulfanato, alkoxy, keto, carboxylic and carboalkoxy radicals;

$R_{19}$ may be a substituted or unsubstituted, saturated or unsaturated, radical selected from the group consisting of H, alkyl, cycloalkyl, alkaryl, aryl, aralkyl and heterocyclic ring; G is selected from the group consisting of (1) —O—, (2) —H($R_{23}$)— and (3) —N($R_{23}R_{24}$)—; $R_{21}$-$R_{24}$ are substituted or unsubstituted radicals independently selected from the group consisting of H, oxygen, linear or branched $C_1$-$C_{12}$ alkyls, alkylenes, alkoxys, aryls, alkaryls, aralkyls, cycloalkyls and heterocyclic rings; provided that any of $R_{18}$, $R_{19}$, $R_{20}$, $R_{21}$-$R_{24}$ may be joined together with any other of R18, $R_{19}$, $R_{20}$, $R_{21}$-$R_{24}$ to form part of a common ring;

and geminal $R_{21}$-$R_{22}$ may combine to form a carbonyl;

and vicinal $R_{21}$-$R_{24}$ may combine to form a substituted or unsubstituted fused unsaturated moiety;

$X^-$ is a suitable charge-balancing counter-ion;

and v is an integer from 1 to 3.

Other preferred bleach boosters are sulphonyl-oxaziridine compounds, oxaziridine quaternary salt compounds, derivatives thereof and combinations thereof.

A highly preferred bleach booster is dihydroisoquinolinium N-propyl sulfonate.

Peracid Incompatible Ingredient

Peracid incompatible ingredients are ingredients which are themselves either inactivated or destroyed upon storage with a source of peracid. Other peracid incompatible ingredients are ingredients which, upon storage with a peracid source, inactivate or destroy said peracid source. Examples of peracid incompatible ingredients include perfumes, enzymes, chelants and combinations thereof.

Preferably the peracid incompatible ingredients are contained in a different compartment of the pouch to the peracid source. The peracid incompatible ingredient may be contained in the same compartment as the optional bleaching ingredients and bleach auxiliary ingredients, this is especially preferred if the peracid incompatible ingredient is more sensitive to the source of peracid than to the optional bleaching ingredients and bleach auxiliary ingredients, and this is also preferred if, in addition to the above, the pouch comprises only two compartments.

Perfumes

Perfumes suitable for use herein include perfumes comprising perfume components which are natural materials such as extracts, essential oils, absolutes, resinoids, resins, concretes and combinations thereof. Other preferred perfumes for use herein include perfumes comprising synthetic materials such as hydrocarbons, alcohols, aldehydes, ketones, ethers, acids, esters, acetals, ketals, nitriles and combinations thereof. The synthetic materials can be saturated or unsaturated compounds, aliphatic, carboxylic and heterocyclic compounds. Perfumes suitable for use herein may comprise a mixture of organic perfume components and synthetic perfume components. The perfume may be an encapsulated perfume. The perfume may comprise a carrier molecule. The perfume may be in the form of a suspended particle.

Enzymes

Enzymes suitable for herein are preferably selected from the group consisting of cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase and mixtures thereof.

Preferred enzymes include protease, amylase, lipase, peroxidases, cutinase and/or cellulase in conjunction with one or more plant cell wall degrading enzymes.

The cellulases usable in the present invention include both bacterial or fungal cellulase. Preferably, they will have a pH optimum of between 5 and 12 and an activity above 50 CEVU (Cellulose Viscosity Unit). Especially suitable cellulases are the cellulases having color care benefits. Carezyme and Celluzyme (Novo Nordisk A/S) are especially useful. Cellulases are normally incorporated in the composition at levels from 0.0001% to 2% of active enzyme by weight of the composition.

Peroxidase enzymes are used to prevent the transfer of dyes or pigments removed from substrates during wash operations to other substrates in the wash solution. Peroxidase enzymes are known in the art, and include, for example, horseradish peroxidase, ligninase and haloperoxidase such as chloro- and bromo-peroxidase. Also suitable is the laccase enzyme. Said peroxidases are normally incorporated in the composition at levels from 0.0001% to 2% of active enzyme by weight of the composition.

Suitable lipase enzymes for use herein include lipases such as M1 Lipase® and Lipomax® (Gist-Brocades) and Lipolase® and Lipolase Ultra® (Novo) which have found to be very effective when used in combination with the composition of the present invention. Also suitable are cutinases, which can be considered as a special kind of lipase, namely lipases which do not require interfacial activation. The lipases and/or cutinases are normally incorporated in the composition at levels from 0.0001% to 2% of active enzyme by weight of the composition.

Suitable proteases are the subtilisins which are obtained from particular strains of *B. subtilis* and *B. licheniformis* (subtilisin BPN and BPN'). One suitable protease is obtained from a strain of *Bacillus*, having maximum activity throughout the pH range of 8-12, developed and sold as ESPERASE® by Novo Industries A/S of Denmark, hereinafter "Novo". Other suitable proteases include ALCALASE®, DURAZYM® and SAVINASE® from Novo and MAXATASE®, MAXACAL®, PROPERASE® and MAXAPEM® (protein engineered Maxacal) from Gist-Brocades. Also suitable for the present invention are proteases described in patent applications EP 251 446 and WO 91/06637, protease BLAP® described in WO91/02792 and their variants described in WO 95/23221. The proteolytic enzymes are incorporated in the composition of the present invention a level of from 0.0001% to 2%, preferably from 0.001% to 0.2%, more preferably from 0.005% to 0.1% pure enzyme by weight of the composition.

Amylases (α and/or β) can be included for removal of carbohydrate-based stains. Examples of commercial α-amylases products are Purafect Ox Am® from Genencor and Termamyl®, Ban®, Fungamyl® and Duramyl®, Natalase® all available from Novo Nordisk A/S Denmark. The amylolytic enzymes are incorporated in the composition of the present invention a level of from 0.0001% to 2%, preferably from 0.00018% to 0.06%, more preferably from 0.00024% to 0.048% pure enzyme by weight of the composition Chelant The composition herein preferably comprises a chelant. By chelant it is meant herein components which act to sequester (chelate) heavy metal ions. Preferably the chelant comprises at least one nitrogen atom. These components may also have calcium and magnesium chelation capacity, but preferentially they show selectivity to binding heavy metal ions such as iron, manganese and copper. Chelants are generally present in the composition at a level of from 0.05% to 2%, preferably from 0.1% to 1.5%, more preferably from 0.25% to 1.2% and most preferably from 0.5% to 1% by weight of the composition herein.

Thickening Agent

The first component and/or the second component, preferably the first component, may comprise a thickening agent. Preferably the first component comprises a thickening agent. Preferred thickening agents are stable in the presence of the peracid source. The thickening agent any have other functions in the composition, for example the thickening agent may be a surfactant. The thickening agent, if present, is present in the composition in the pouch, and the term "thickening agent" used herein, does not include compounds or ingredients present in the pouch material.

Preferred thickening agents comprise one or more, preferably two or more surfactants. Other preferred thickening agents comprise at least one surfactant and at least one electrolyte, preferred electrolytes are inorganic salts. Other suitable thickening agents are tertiary amine oxides comprising a $C_{8-22}$ alkyl chain or tertiary alkyl amine oxides comprising two or more $C_{1-5}$ alkyl chains. Preferred thickening agents comprise a tertiary amine oxide in combination with an anionic surfactant.

Other preferred thickening agents comprise a polymeric material, preferably a polymer of acrylic acid. Other preferred thickening agents are synthetic homo-polymers, co-polymers, ter-polymers, or a combination thereof, of acrylic acid, maleic acid, asparic acid, or vinyl ester, and having a molecular weight of at least 200 kDa, preferably at least 300 kDa, more preferably at least 500 kDa, even more preferably at least 750 kDa, most preferably at least 1000 kDa. Preferably, the said polymer is hydrophobically modified. Preferably the said polymer is a cross-linked polyacrylate. Preferred cross-linked polyacrylates are selected from the group consisting of acrylic acid polymer cross-linked with alkyl ethers of pentaerythrol or sucrose, vinyl ester acrylate cross-polymer, $C_{10}$-$C_{30}$ alkyl acrylate cross-polymer, polymer of acrylic acid covalently bound with hydrophobic groups, acrylonitrogen co-polymer, steareth 20 methacrylate co-polymer. A preferred thickening agent comprises a polymer with similar properties to the polymer known under the trade name as Acusol.

Other preferred thickening agents are gums selected from the group consisting of karaya gum, tragacanth gum, guar gum, locust bean gum, alginates, carragean, xanthan gum, or a combination thereof. Preferably the said gum has a molecular weight of at least 100 kDa, preferably at least 200 kDa, more preferably at least 500 kDa, even more preferably at least 750 kDa, most preferably at least 1000 kDa.

Other preferred thickening agents are starches. The said starches are natural or synthetically modified polymers of amylose and amylopectin.

Other preferred thickening agents are carboxy methyl celluloses or derivatives thereof, having an average molecular weight of at least 200 kDa, preferably at least 300 kDa, more preferably at least 500 kDa, even more preferably at least 750 kDa, most preferably at least 1000 kDa. Preferred carboxy methyl celluloses and derivatives thereof are selected from the group consisting of carboxy methyl cellulose, hydroxyethyl cellulose HEC, hydrophobically modified HEC, hydroxypropyl cellulose HPC, hydroxypropylmethyl cellulose, hydroxybutylmethyl cellulose.

Other preferred thickening agents are polyethylene glycols, having a molecular weight of at least 100 kDa, preferably at least 200 kDa, more preferably at least 500 kDa, even more preferably at least 750 kDa most preferably at least 1000 kDa.

Preferred thickening agents are clays selected from the group consisting of smectite clay, hectorite clay, bentonite clay or a combination thereof.

Effervescence System

The first component preferably comprises an effervescence system. The effervescence system improves the dispensing of the bleaching ingredient comprised by the first component, and reduces the risk of patchy damage occurring to fabric. Preferably the first component is a non-aqueous liquid and comprises an effervescence system. This prevents effervescence occurring until the pouch is dissolved or disintegrated, or starts to dissolved or disintegrate, in the wash liquor.

A preferred effervescence system comprises an acid source capable of reacting with an alkali source in the presence of water to produce a gas. The gas produced by this interaction, includes nitrogen, oxygen and carbon dioxide gas. The acid source may be any organic, mineral or inorganic acid, or a derivative thereof, or a mixture thereof. Preferably the acid source comprises an organic acid. Suitable acid sources include citric, malic, maleic, fumaric, aspartic, glutaric, tartaric succinic or adipic acid, monosodium phosphate, boric acid, or derivatives thereof. Citric acid, maleic or malic acid are especially preferred.

As discussed hereinbefore, the effervescence system preferably comprises an alkali source, however, for the purpose of the invention, it should be understood that the alkali source may be part of the component or can be part of a composition comprising the component, or can be present in the washing liquor, whereto the component, or a composition comprising the component, is added. Any alkali source which has the capacity to react with the acid source to produce a gas may used herein. Preferred alkali sources can be perhydrate bleaches, including perborate, and silicate material.

Preferably the gas is carbon dioxide, and therefore the alkali source is a preferably a source of carbonate, which can be any source of carbonate known in the art. In a preferred embodiment, the carbonate source is a carbonate salt. Examples of preferred carbonates are the alkaline earth and alkali metal carbonates, including sodium or potassium carbonate, bicarbonate and sesqui-carbonate and any mixtures thereof with ultra-fine calcium carbonate such as are disclosed in German Patent Application No. 2,321,001 published on Nov. 15, 1973. Alkali metal percarbonate salts are also suitable sources of carbonate species, which may be present combined with one or more other carbonate sources.

The molecular ratio of the acid source to the alkali source present in the component is preferably from 50:1 to 1:50, more preferably from 20:1 to 1:20 more preferably from 10:1 to 1:10, more preferably from 5:1 to 1:3, more preferably from 3:1 to 1:2, more preferably from 2:1 to 1:2.

Detersive Surfactants

Nonionic Alkoxylated Surfactant

Essentially any alkoxylated nonionic surfactants can be comprised by the composition herein. These nonionic surfactants are in addition to the alkoxylated compound of the invention. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Highly preferred are nonionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Nonionic Polyhydroxy Fatty Acid Amide Surfactant

Polyhydroxy fatty acid amides are highly preferred nonionic surfactant comprised by the composition, in particular those having the structural formula $R^2CONR^1Z$ wherein: R1 is H, $C_{1-18}$, preferably $C_1$-$C_4$ hydrocarbyl, 2-hydroxy ethyl, 2-hydroxy propyl, ethoxy, propoxy, or a mixture thereof, preferable $C_1$-$C_4$ alkyl, more preferably $C_1$ or $C_2$ alkyl, most preferably $C_1$ alkyl (i.e., methyl); and $R_2$ is a $C_5$-$C_{31}$ hydrocarbyl, preferably straight-chain $C_5$-$C_{19}$ or $C_7$-$C_{19}$ alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

A highly preferred nonionic polyhydroxy fatty acid amide surfactant for use herein is a $C_{12}$-$C_{14}$, a $C_{15}$-$C_{17}$ and/or $C_{16}$-$C_{18}$ alkyl N-methyl glucamide.

It may be particularly preferred that the composition herein comprises a mixture of a $C_{12}$-$C_{18}$ alkyl N-methyl glucamide and condensation products of an alcohol having an alkyl group containing from 8 to 20 carbon atoms with from 2 to 9 moles and in particular 3 or 5 moles, of ethylene oxide per mole of alcohol.

The polyhydroxy fatty acid amide can be prepared by any suitable process. One particularly preferred process is described in detail in WO 9206984. A product comprising about 95% by weight polyhydroxy fatty acid amide, low levels of undesired impurities such as fatty acid esters and cyclic amides, and which is molten typically above about 80° C., can be made by this process.

Nonionic Fatty Acid Amide Surfactant

Fatty acid amide surfactants or alkoxylated fatty acid amides can also be comprised by the composition herein. They include those having the formula: $R^6CON(R^7)(R^8)$ wherein $R^6$ is an alkyl group containing from 7 to 21, preferably from 9 to 17 carbon or even 11 to 13 carbon atoms and $R^7$ and $R^8$ are each individually selected from the group consisting of hydrogen, $C_1$-$C_4$ alkyl, $C_1$-$C_4$ hydroxyalkyl, and —$(C_2H_4O)_xH$, where x is in the range of from 1 to 11, preferably 1 to 7, more preferably from 1-5, whereby it may be preferred that $R^7$ is different to $R^8$, one having x being 1 or 2, one having x being from 3 to 11 or preferably 5.

Nonionic Alkyl Esters of Fatty Acid Surfactant

Alkyl esters of fatty acids can also be comprised by the composition herein. They include those having the formula: $R^9COO(R^{10})$ wherein $R^9$ is an alkyl group containing from 7 to 21, preferably from 9 to 17 carbon or even 11 to 13 carbon atoms and $R^{10}$ is a $C_1$-$C_4$ alkyl, $C_1$-$C_4$ hydroxyalkyl, or —$(C_2H_4O)_xH$, where x is in the range of from 1 to 11, preferably 1 to 7, more preferably from 1-5, whereby it may be preferred that $R^{10}$ is a methyl or ethyl group.

Nonionic Alkylpolysaccharide Surfactant

Alkylpolysaccharides can also be comprised by the composition herein, such as those disclosed in U.S. Pat. No. 4,565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula $$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Polyethylene/Propylene Glycols

The composition herein may comprise polyethylene and/or propylene glycol, particularly those of molecular weight 1000-10000, more particularly 2000 to 8000 and most preferably about 4000.

Anionic Surfactant

The composition herein, preferably comprises one or more anionic surfactants. Any anionic surfactant useful for detersive purposes is suitable. Examples include salts (including, for example, sodium, potassium, ammonium, and substituted ammonium salts such as mono-, di- and triethanolamine salts) of the anionic sulphate, sulphonate, carboxylate and sarcosinate surfactants. Anionic sulphate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulphate Surfactant

Anionic sulphate surfactants suitable for use herein include the linear and branched primary and secondary alkyl sulphates, alkyl ethoxysulphates, fatty oleoyl glycerol sulphates, alkyl phenol ethylene oxide ether sulphates, the $C_5$-$C_{17}$ acyl-N-($C_1$-$C_4$ alkyl) and -N-($C_1$-$C_2$ hydroxyalkyl) glucamine sulphates, and sulphates of alkylpolysaccharides such as the sulphates of alkylpolyglucoside (the nonionic non-sulphated compounds being described herein).

Alkyl sulphate surfactants are preferably selected from the linear and branched primary $C_9$-$C_{22}$ alkyl sulphates, more preferably the $C_{11}$-$C_{15}$ branched chain alkyl sulphates and the $C_{12}$-$C_{14}$ linear chain alkyl sulphates.

Alkyl ethoxysulfate surfactants are preferably selected from the group consisting of the $C_{10}$-$C_{18}$ alkyl sulphates which have been ethoxylated with from 0.5 to 50 moles of ethylene oxide per molecule. More preferably, the alkyl ethoxysulfate surfactant is a $C_{11}$-$C_{18}$, most preferably $C_{11}$-$C_{15}$ alkyl sulphate which has been ethoxylated with from 0.5 to 7, preferably from 1 to 5, moles of ethylene oxide per molecule.

Anionic Sulphonate Surfactant

Anionic sulphonate surfactants suitable for use herein include the salts of $C_5$-$C_{20}$ linear or branched alkylbenzene sulphonates, alkyl ester sulphonates, in particular methyl ester sulphonates, $C_6$-$C_{22}$ primary or secondary alkane sulphonates, $C_6$-$C_{24}$ olefin sulphonates, sulphonated polycarboxylic acids, alkyl glycerol sulphonates, fatty acyl glycerol sulphonates, fatty oleyl glycerol sulphonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_x\ CH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—$(CHR_1$—$CHR_2$—$O)_xR_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressers.

Alkali Metal Sarcosinate Surfactant

Other suitable anionic surfactants are the alkali metal sarcosinates of formula R—CON $(R^1)CH_2$ COOM, wherein R is a $C_5$-$C_{17}$ linear or branched alkyl or alkenyl group, $R^1$ is a $C_1$-$C_4$ alkyl group and M is an alkali metal ion. Preferred examples are the myristyl and oleoyl methyl sarcosinates in the form of their sodium salts.

Cationic Surfactant

Another preferred surfactant is a cationic surfactant, which may preferably be present at a level of from 0.1% to 60% by weight of the composition herein, more preferably from 0.4% to 20%, most preferably from 0.5% to 5% by weight of the composition herein.

When present, the ratio of the anionic surfactant to the cationic surfactant is preferably from 35:1 to 1:3, more preferably from 15:1 to 1:1. most preferably from 10:1 to 1:1.

Preferably the cationic surfactant is selected from the group consisting of cationic ester surfactants, cationic mono-alkoxylated amine surfactants, cationic bis-alkoxylated amine surfactants and mixtures thereof.

Amphoteric Surfactant

Suitable amphoteric surfactants for use herein include the amine oxide surfactants and the alkyl amphocarboxylic acids.

Zwitterionic Surfactant

Zwitterionic surfactants can also be comprised by the composition herein. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Building Agent

Water-soluble Building Agent

The composition herein may comprises a water-soluble building agent, typically present at a level of from 0% to 36% by weight, preferably from 1% to 35% by weight, more preferably from 10% to 35%, even more preferably from 12% to 30% by weight of the composition or particle. Preferably, the water-soluble builder compound is an alkali or earth alkali metal salt of phosphate present at the level described above.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from about 6 to 21, and salts of phytic acid.

Other typical water-soluble building agents include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, phosphates, and mixtures of any of the foregoing.

Water-insoluble Building Agent

The composition herein preferably comprises a water-insoluble building agent. Examples of water insoluble builders include the sodium aluminosilicates.

Suitable aluminosilicate zeolites have the unit cell formula $Na_z[(AlO_2)_z(SiO_2)y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

Suds Suppressing System

The composition may comprise a suds suppresser at a level less than 10%, preferably 0.001% to 10%, preferably from 0.01% to 8%, most preferably from 0.05% to 5%, by weight of the composition Preferably the suds suppresser is either a soap, paraffin, wax, or any combination thereof. If the suds suppresser is a suds suppressing silicone, then the detergent composition preferably comprises from 0.005% to 0.5% by weight a suds suppressing silicone.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of the composition herein, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units. Preferably the composition herein comprises from 0.005% to 0.5% by weight suds suppressing silicone.

Polymeric Dye Transfer Inhibiting Agents

The composition herein may also comprise from 0.01% to 10%, preferably from 0.05% to 0.5% by weight of polymeric dye transfer inhibiting agents. These polymeric dye transfer inhibiting agents are in addition to the polymeric material of the water-soluble film. The polymeric dye transfer inhibiting agents are preferably selected from polyamine N-oxide polymers, copolymers of N-vinylpyrrolidone and N-vinylimidazole, polyvinylpyrrolidonepolymers or combinations thereof.

Cationic Fabric Softening Agents

Cationic fabric softening agents are preferably present in the composition herein. Suitable cationic fabric softening agents include the water insoluble tertiary amines or dilong chain amide materials as disclosed in GB-A-1 514 276 and EP-B-0 011 340. Preferably, these water-insoluble tertiary amines or dilong chain amide materials are comprised by the solid component of the composition herein. Cationic fabric softening agents are typically incorporated at total levels of from 0.5% to 15% by weight, normally from 1% to 5% by weight.

Other Optional Ingredients

Other optional ingredients suitable for inclusion in the composition herein include optical brighteners, perfumes, colours and filler salts, with sodium sulphate being a preferred filler salt.

EXAMPLES

Abbreviations Used in the Following Examples

| Abbreviation | Description |
|---|---|
| PAP | N,N-Pthaloyl amido peroxy caproic acid |
| TAED | Tetra acetyl ethylene diamine |
| TCPAP | N,N' Terephtaloyl di(6-amino peroxycaproic acid |
| NOBS | Nonanoly oxy benzene sulfonate |
| NAC-OBS | Nonanoly amido caproic oxy benzene sulpfonate |

-continued

| Abbreviation | Description |
|---|---|
| Percarbonate | Sodium percarbonate of the nominal formula $2Na_2CO_3.3H_2O$ |
| Anionic surfactant | Sodium linear $C_{11}$–$C_{13}$ alkyl benzene sulfonate |
| Nonionic surfactant | $C_{12}$–$C_{18}$ predominantly linear primary alcohol condensed with an average of from 1 to 7 moles of ethylene oxide |
| Cationic surfactant | $R_2.N + (CH_3)(C_2H_4OH)_2$, wherein $R_2 = C_7$–$C_{12}$ |
| Zeolite A | Hydrated sodium aluminosilicate of the formula $Na_{12}(AlO_2SiO_2)_{12}.27H_2O$ having a primary particle size in the range of from 0.1 to 10 micrometers (weight expressed on an anhydrous basis) |
| Quaternary imine salt | di-hydroisoquinolinium N-propyl sulfonate |
| Brightener | Disodium 4,4'-bis-(2-sulfostyryl)biphenyl, supplied by Ciba-Geigy under the tradename Tinopal CBS |
| Amylase | Amylolytic enzyme having an activity of from 15 mg/g to 25 mg/g active enzyme, supplied by Novo Industries A/S under the tradename Termamyl |
| Cellulase | Cellulolytic enzyme having an activity of from 1 mg/g to 5 mg/g active enzyme, supplied by Novo Industries A/S under the tradename Carezyme |
| Lipase | Lipolytic enzyme having an activity of from 5 mg/g to 20 mg/g active enzyme, supplied by Novo Industries A/S under the tradename Lipolase Ultra |
| Mannanase | Mannanase enzyme having an activity of from 25 mg/g active enzyme |
| Protease | Proteolytic enzyme having an activity of from 15 mg/g to 75 mg/g active enzyme, supplied by Novo Industries A/S under the tradename as Savinase, or supplied by Genencor under the tradename FN2, FN3, or FN4 |
| Perfume | Un-encapsulated or an encapsulated perfume |
| Sulphate | Anhydrous sodium sulphate |
| Carbonate | Anhydrous sodium carbonate |
| Smectite clay | Montmorillonite clay or hectorite clay |

Example 1

A detergent composition in a dual-compartment pouch, which is in accord with the present invention, is described. The dual compartment pouch is made from a Monosol M8630 film as supplied by Chris-Craft Industrial Products. The ingredients of the first component and second component of the composition, which are contained in different compartments of the pouch, are described. The first component comprises mineral oil as a liquid matrix, and comprises PAP in the form of suspended particles, which are suspended in the mineral oil. The second component is a liquid.

| | Amount (% wt of total composition) |
|---|---|
| First component ingredients | |
| PAP | 2% to 10% |
| Mineral oil | 4% to 15% |
| Second component ingredients | |
| Anionic surfactant | 5% to 20% |
| Nonionic surfactant | 5% to 20% |
| Cationic surfactant | 0% to 5% |
| Citric acid | 0.5% to 2% |
| Fatty acid | 12% to 20% |
| Brightener | 0.1% to 0.4% |
| Amylase | 0% to 0.4% (% active enzyme) |

-continued

| | Amount (% wt of total composition) |
|---|---|
| Cellulase | 0.01% to 0.4% (% active enzyme) |
| Lipase | 0% to 0.4% (% active enzyme) |
| Mannanase | 0% to 0.4% (% active enzyme) |
| Protease | 0.01% to 0.4% (% active enzyme) |
| Perfume | 0% to 3% |
| Propanediol | 10% to 20% |
| Monoethanolamine | 5% to 20% |
| Water | 0% to 20% |
| First & second component ingredients | |
| Miscellaneous ingredients | to 100% |

Examples 2, 3 and 4

As the detergent composition described in example 1, except that the pouch is made from a PT film supplied by Aicello (example 2), or a K-series film supplied by Aicello (example 3), or VF-HP film supplied by Kuraray (example 4).

Examples 5, 6 and 7

As the detergent composition described in example 1, except that from 0.1% to 20% TAED (example 5), from 0.1% to 20% NOBS (example 6) and from 0.1% to 20% NAC-OBS (Example 7) are used instead of PAP as the bleaching ingredient in the first component, respectively, and from 0% to 15% percarbonate is comprised by the second component.

Examples 8, 9 and 10

As the detergent compositions described in example 5, 6 and 7, respectively, except that a mixture of a nonionic surfactant and propanediol (having a weight ratio of 4:1) is used instead of mineral oil as the liquid matrix of the first component.

Example 11

A detergent composition in a dual-compartment pouch, which is in accord with the present invention, is described. The dual compartment pouch is made from a Monosol M8630 film as supplied by Chris-Craft Industrial Products. The ingredients of the first component and second component of the composition, which are contained in different compartments of the pouch, are described. The first component is a liquid, which comprises PAP in the form of suspended particles, and mineral oil as the liquid matrix. The second component is a solid.

| | Amount (% wt of total composition) |
|---|---|
| First component ingredients | |
| PAP | 2% to 10% |
| Mineral oil | 4% to 15% |
| Second component ingredients | |
| Anionic surfactant | 10% to 20% |
| Nonionic surfactant | 0% to 20% |
| Cationic surfactant | 0% to 5% |

-continued

| | Amount (% wt of total composition) |
|---|---|
| Zeolite A | 5% to 30% |
| Quaternary imine salt | 0% to 1% |
| Brightener | 0.1% to 0.4% |
| Amylase | 0% to 0.4% (% active enzyme) |
| Cellulase | 0.01% to 0.4% (% active enzyme) |
| Lipase | 0% to 0.4% (% active enzyme) |
| Mannanase | 0% to 0.4% (% active enzyme) |
| Protease | 0.01% to 0.4% (% active enzyme) |
| Perfume | 0% to 3% |
| Sulphate | 5% to 30% |
| Carbonate | 5% to 30% |
| First & second component ingredients | |
| Miscellaneous ingredients | to 100% |

Examples 12, 13 and 14

As the detergent composition described in example 11, except that from 0.1% to 20% TAED (example 12), from 0.1% to 20% NOBS (example 13) and from 0.1% to 20% NAC-OBS (Example 14) are used instead of PAP as the bleaching ingredient in the first component, respectively, and from 0% to 15% percarbonate is comprised by the second component.

Example 15, 16 and 17

As the detergent composition described in example 11, except that the pouch is made from a PT film supplied by Aicello (example 15), or a K-series film supplied by Aicello (example 16), or VF-HP film supplied by Kuraray (example 17).

Example 18

A detergent composition in a dual-compartment pouch, which is in accord with the present invention, is described. The dual compartment pouch is made from a Monosol M8630 film as supplied by Chris-Craft Industrial Products. The ingredients of the first component and second component of the composition, which are contained in different compartments of the pouch, are described. The first component is a liquid, which comprises PAP in the form of suspended particles, and mineral oil as the liquid matrix. Zeolite A is the form of suspended particles. The second component is a liquid.

| | Amount (% wt of total composition) |
|---|---|
| First component ingredients | |
| PAP | 2% to 10% |
| Mineral oil | 4% to 25% |
| Zeolite A | 5% to 25% |
| Citric acid | 0% to 5% |
| Carbonate | 0% to 10% |
| Brightener | 0.1% to 0.4% |
| Neodol 24-7 nonionic surfactant | 10% to 20% |
| Anionic surfactant | 5% to 20% |
| Monoethanolamine | 5% to 15% |
| Smectite clay | 0% to 15% |
| Second component ingredients | |
| Cationic surfactant | 0% to 5% |
| Amylase | 0% to 0.4% (% active enzyme) |

-continued

| | Amount (% wt of total composition) |
|---|---|
| Cellulase | 0.01% to 0.4% (% active enzyme) |
| Lipase | 0% to 0.4% (% active enzyme) |
| Mannanase | 0% to 0.4% (% active enzyme) |
| Protease | 0.01% to 0.4% (% active enzyme) |
| Perfume | 0% to 3% |
| Propanediol | 10% to 15% |
| Monoethanolamine | 1% to 15% |
| Water | 0% to 20% |
| First & second component ingredients | |
| Miscellaneous ingredients | to 100% |

Examples 19, 20 and 21

As the detergent composition described in example 18, except that from 0.1% to 20% TAED (example 19), from 0.1% to 20% NOBS (example 20) and from 0.1% to 20% NAC-OBS (Example 21) are used instead of PAP as the bleaching ingredient in the first component, respectively, and from 0% to 15% percarbonate is comprised by the second component.

Examples 22, 23 and 24

As the detergent composition described in example 18, except that the pouch is made from a PT film supplied by Aicello (example 22), or a K-series film supplied by Aicello (example 23), or VF-HP film supplied by Kuraray (example 24).

Examples 25, 26 and 27

As the detergent composition described in examples 5, 6 and 7, respectively, except that the percarbonate is comprised by the first component.

Examples 28, 29 and 30

As the detergent composition described in examples 12, 13 and 14, respectively, except that the percarbonate is comprised by the first component.

Examples 31, 32 and 33

As the detergent composition described in examples 22, 23 and 24, respectively, except that the percarbonate is comprised by the first component.

Examples 34, 35 and 36

As the detergent compositions described in example 12, 13 and 14, respectively, except that a mixture of a nonionic surfactant and propanediol (having a weight ratio of 4:1) is used instead of mineral oil as the liquid matrix of the first component.

Examples 37, 38 and 39

As the detergent compositions described in example 22, 23 and 24, respectively, except that a mixture of a nonionic surfactant and propanediol (having a weight ratio of 4:1) is used instead of mineral oil as the liquid matrix of the first component.

Example 40

As the detergent composition described in example, except that TPCAP is comprised by the first component instead of PAP.

Example 41

As the detergent described in example 1, except that the first component comprises from 10% to 30% water, instead of mineral oil, and the first component also comprises (by weight of the total composition) from 1% to 10% magnesium sulfate and from 1% to 5% succinic acid.

Example 42

Laundry articles making up one washing load are cleaned in an automatic washing machine with from one to three pouches weighing from 20 g to 50 g which are added either to the drum of the automatic washing machine or the dispenser draw of the automatic washing machine. The pouches contain a detergent compositions described in any of examples 1 to 41.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multiple compartment water soluble pouch containing a detergent composition, said pouch comprising at least two compartments comprising:

a first compartment containing: a first component of said detergent composition, said first component comprising a mineral oil liquid matrix and a source of peracid; and a second compartment joined to said first compartment, said second compartment containing a second component of said detergent composition, wherein the compartments of the pouch containing said components are of a different color from each other.

2. The multiple compartment pouch of claim 1 wherein the first compartment is green or blue and the second compartment is white.

3. The multiple compartment pouch of claim 1 wherein the first compartment is translucent, transparent, or semi-transparent and the second compartment is opaque or semi-opaque.

4. The multiple compartment pouch of claim 2 wherein the first compartment is translucent, transparent, or semi-transparent and the second compartment is opaque or semi-opaque.

5. The multiple compartment pouch of claim 1 wherein said second component comprises a solid matrix.

6. The multiple compartment pouch of claim 2 wherein said second component comprises a solid matrix.

7. The multiple compartment pouch of claim 3 wherein said second component comprises a solid matrix.

8. The multiple compartment pouch of claim 1 wherein said pouch comprises at least three pieces of pouch material comprising a first piece of pouch material, a second piece of pouch material, and a third piece of pouch material, wherein said second piece of pouch material is positioned so that it at least partially overlaps the first piece of pouch material and said first piece of pouch material and said second piece of pouch material are sealed together, and said third piece of pouch material creates a barrier layer between said first and second pieces of pouch material that divides the pouch into said at least two compartments.

9. The multiple compartment pouch of claim 1 wherein the first and second compartments are of different sizes, having different internal volumes.

10. The multiple compartment pouch of claim 2 wherein the first and second compartments are of different sizes, having different internal volumes.

11. The multiple compartment pouch of claim 3 wherein the first and second compartments are of different sizes, having different internal volumes.

12. The multiple compartment pouch of claim 5 wherein the first and second compartments are of different sizes, having different internal volumes.

13. The multiple compartment pouch of claim 8 wherein the first and second compartments are of different sizes, having different internal volumes.

14. The multiple compartment pouch of claim 5 wherein the first compartment also contains an air bubble.

15. A multiple compartment water soluble pouch containing a detergent composition, said pouch comprising at least two compartments comprising:

a first compartment containing a first component of said detergent composition, which first component comprises a mineral oil liquid matrix and a source of peracid, wherein said first compartment also contains an air bubble having a volume of no more than 50% of the volume space of said first compartment; and a second compartment joined to said first compartment, said second compartment containing a second component of said detergent composition.

16. The multiple compartment pouch of claim 15 wherein said liquid matrix has a viscosity of at least 300 mPas.

17. The multiple compartment pouch of claim 15 wherein said pouch comprises at least three pieces of pouch material comprising a first piece of pouch material, a second piece of pouch material, and a third piece of pouch material, wherein said second piece of pouch material is positioned so that it at least partially overlaps the first piece of pouch material and said first piece of pouch material and said second piece of pouch material are sealed together, and said third piece of pouch material creates a barrier layer between said first and second pieces of pouch material that divides the pouch into said at least two compartments.

18. The multiple compartment pouch of claim 15 wherein said liquid matrix comprises dispersed and/or suspended solid particles.

19. The multiple compartment pouch of claim 15 wherein the second component comprises a solid matrix.

20. The multiple compartment pouch of claim 19 wherein said solid matrix comprises peracid incompatible ingredients.

21. The multiple compartment pouch of claim 20 wherein said peracid incompatible ingredients are selected from perfumes, enzymes, chelants and combinations thereof.

22. A multiple compartment water soluble pouch containing a detergent composition, said pouch comprising at least two compartments comprising:

a first compartment containing a first component of said detergent composition, which first component comprises a mineral oil liquid matrix and a source of peracid, wherein said first compartment also contains an air bubble having a volume of no more than 50% of the volume space of said first compartment; and a second compartment joined to said first compartment, said second compartment containing a second component of said detergent composition, wherein said pouch is configured to at least partially dissolve in such a manner that it dispenses said first component before said second component.

* * * * *